US006182868B1

(12) United States Patent
Hurray et al.

(10) Patent No.: US 6,182,868 B1
(45) Date of Patent: Feb. 6, 2001

(54) TWO-COMPONENT POLYURETHANE BOX KIT

(75) Inventors: Paul Gregory Hurray, Akron; Stefan Gantenbein, Medina, both of OH (US)

(73) Assignee: Fomo Products, Inc., Norton, OH (US)

( * ) Notice: Under 35 U.S.C. 154(b), the term of this patent shall be extended for 0 days.

(21) Appl. No.: 09/415,637

(22) Filed: Oct. 12, 1999

(51) Int. Cl.[7] ..... B67D 5/60

(52) U.S. Cl. ..... 222/145.1; 222/145.1; 222/145.5; 222/145.6; 229/122; 169/30

(58) Field of Search ..... 239/302, 303, 239/304; 169/30; 222/145.1, 145.5, 145.6; 229/122

(56) References Cited

U.S. PATENT DOCUMENTS 3,613,956 * 10/1971 McCulloch ..... 222/145.1 X
3,633,795 * 1/1972 Brooks ..... 222/134
4,252,236 * 2/1981 Roccaforte ..... 229/122 X
5,242,115 9/1993 Brown .
5,344,051 * 9/1994 Brown ..... 222/145.1 X
5,526,957 * 6/1996 Brown et al. ..... 222/145.5 X
5,924,599 * 7/1999 Brown ..... 222/145.1 X

* cited by examiner

*Primary Examiner*—Andres Kashnikow
*Assistant Examiner*—Robin O. Evans
(74) *Attorney, Agent, or Firm*—Frank J. Nawalanic

(57) ABSTRACT

A carton for a portable two-component polyurethane foam spray kit has front and rear panels interconnected at their vertically extending ends with carton sides to form a rectangular opening closed at its bottom by bottom flaps. A top cover flap has valve openings allowing the kit user to open and close pressurized "A" and "B" polyurethane cylinders carried in the carton without opening the carton. The carton is carried by a strap secured to the cylinders extending through the top of the carton. A closeable, punch-out front flap formed as part of the front panel allows the kit hoses to be attached to the cylinders and the dispensing gun and stored for shipment and use within the carton between the cylinders and the front panel.

17 Claims, 5 Drawing Sheets

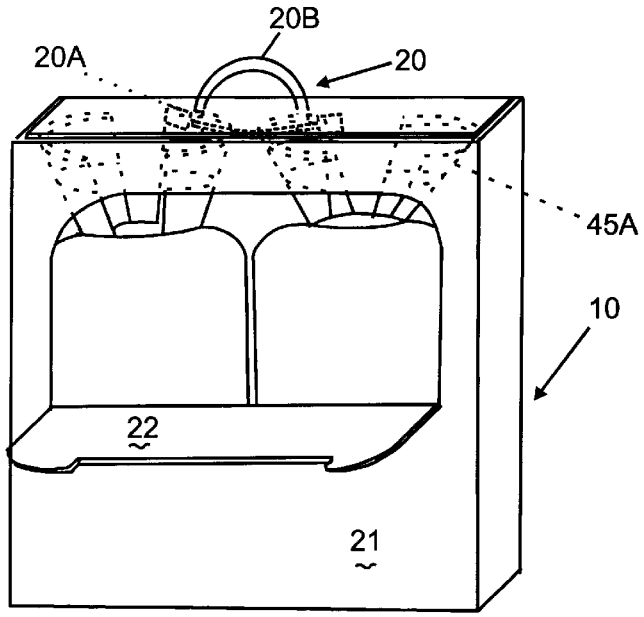
FIG. 8
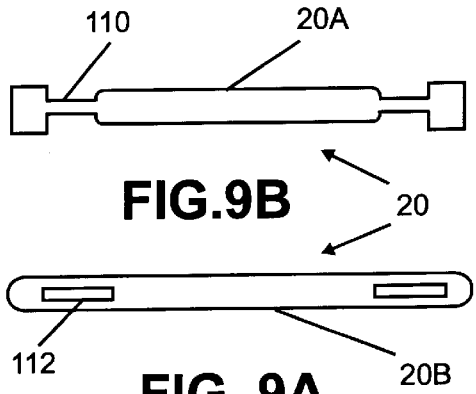
FIG.9B
FIG. 9A
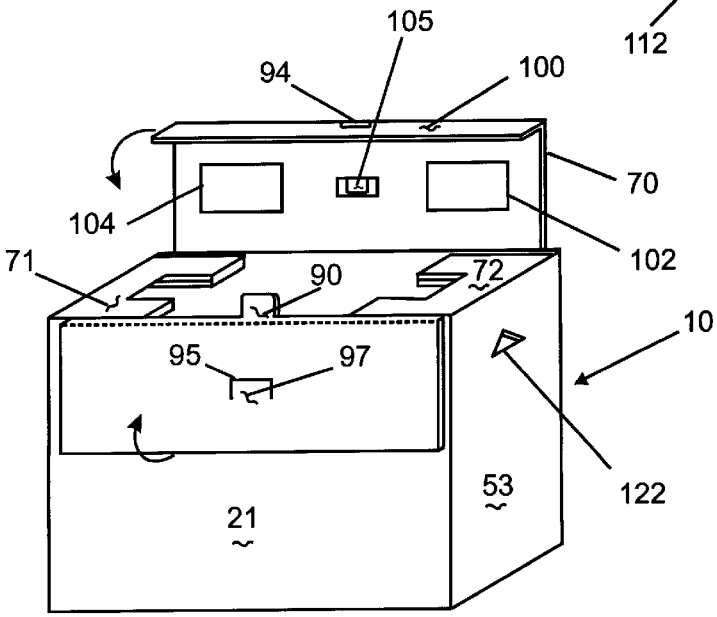
FIG. 10

TWO-COMPONENT POLYURETHANE BOX KIT

This invention relates generally to an article packaging kit and more particularly to a carton or box containing a portable, two-component polyurethane froth foam kit for in-situ application of polyurethane foam.

BACKGROUND

There are numerous applications in which polyurethane foam is used at a site for any number of applications in addition to its traditional use in the building trades as a source of insulation. Recently polyurethane foam has become used with increasing frequency as a sealant in the building trades for sealing spaces between window and door frames and the like and as an adhesive for glueing flooring and roof tiles and the like. The polyurethane foam for such in situ applications is typically supplied as a one-component froth foam or a two-component froth foam. A one-component foam means that both the resin and isocyanate for the foam is supplied in a single pressurized container and dispensed from the container through a valve or gun attached to the container. A two-component "froth" foam means that one component is supplied in one pressurized container, typically the "A" container (i.e., polymeric isocyanate, fluorocarbons etc) while the resin is supplied in a second pressurized container, typically the "B" container (i.e., polyols, catalyst, flame retardants etc.). Typically two-component kits use pressurized cylinders about 7½" in diameter which are connected by hoses to a dispensing gun. There are advantages and disadvantages to one-component and two-component foams. One of the advantages of the two-component system is its relatively long shelf life resulting from the fact that the chemicals are not mixed until they encounter one-another in the dispensing gun. This invention relates to two-component foams.

One particularly unique application for a hand-held, portable two-component polyurethane froth foam kit exists in the mining industry. In the event of a fire in a shaft being tunneled, standard procedure is to extinguish the fire by sealing the shaft with a fire "door" and then pumping out from the shaft sealed by the door, the air in the shaft to extinguish the fire. It has been found that polyurethane foam is excellent for sealing the bulkhead or door to the tunnel. As already noted, the polyurethane foam has an adhesive characteristic and the foam can be formulated to provide a relatively quick tack free time with little permeability for gas escape. Surprisingly, the fire door is not adjacent an open flame, and whatever temperature the gases exhausted from the shaft are, they are not sufficiently high in temperature to disintegrate the foam. Because of its long shelf life, a two-component foam is ideal for this application. Standard procedure is to simply provide two-component kits at the shaft being tunneled to seal and secure the fire door or bulkhead to the shaft in the event of a fire.

A two-component kit means the "A" and "B" cylinders, the dispensing gun and the hoses connecting the cylinders to the gun. Typically, these items are packaged in a cardboard container, box or carton and the carton is then used to hand carry the items to the site where the foam is to be dispensed. Because the cylinders are pressure vessels and contain chemicals that are deemed hazardous material, the carton must house the cylinders in such a manner that extensive safety regulations are complied with during shipping. One of the regulations require that the valve in the pressurized cylinders be shielded or guarded. See, for example, 49

C.F.R. subpart L, Sections 178.500 et seq. This regulation is typically complied with by providing a plastic or cardboard sheath or tube which fits over the valve stem protruding from the cylinder. When the kit is opened the sheath or tube is discarded and the hoses attached. Alternatively, the cylinder may be of a design where a sheet metal crown or guard is provided which surrounds or partially surrounds the valve stem. The crown typically has an opening for hand carrying the cylinder. Other regulations require the shipping carton to have sufficient strength and rigidity to permit stacking, dropping, etc.

A typical container for a two-component kit is a cardboard, fold-out box with a separate cardboard tray. The tray fits over the valved ends of the cylinders to hold the cylinders in place in the box during shipment and is integrated into the box such as by folding flaps fitting into tray slots at the box end adjacent the tray. The tray holds the cylinders and the box flaps hold the tray to the box. In the top of the tray, the hoses are placed in a coiled manner with the dispensing gun. To use, the operator opens the box end adjacent the tray and removes knock-out holes in the front face of the box. The hoses are then placed through the knock-out openings and tightened to the cylinder's valve fitting from above (discarding the protective shipping tubes) and the valves are opened. The cover is then folded back into the box to close the box and the hoses extend out of the box. Because the box end adjacent the tray has to be opened and closed to open and close the valves for use of the dispensing gun, the box is usually provided with a strap at the opposite box end which does not open. This means that the box is carried with the cylinders upside-down. However, this carton is perfectly acceptable for portable, hand-held, polyurethane froth foam in situ applications such as typically encountered in the building trades.

Different packaging arrangements are used by different manufacturers. Many two-component kit packages use some form of tray with knock-out holes through which the hoses extend after the box is opened and the hoses attached to the cylinder's valved fitting. However, there is at least one two-component polyurethane froth foam box which utilizes cylinders equipped with "dip tubes" which extend through the outlet valve from the inside bottom of the cylinder. This allows the cylinders to be placed upright in the box instead of upside down. This carton does not use a tray and has the hoses extend out the side of the box through knock-out plugs. The carton is carried by a strap affixed to the top cover. The top cover is a flap which has to be opened and closed to gain access to the cylinder's valve after the hoses are connected to the cylinders. While tests have not been conducted, the integrity of the carrying handle may be compromised if the box is constantly opened and closed.

In the mining application discussed, the two-component kits are simply left on the tunnel floor. The floor is moist and oftentimes wet. In time the moisture and/or water will weaken the cardboard corrugations rendering the box useless for carrying the two-component kit components to the site where the polyurethane foam is to be sprayed. Coating the box with a wax or plastic coating to make it more impervious to moisture significantly increases the cost of the carton and is not completely effective in preventing water from penetrating the cardboard corrugations. More importantly, when a fire occurs, there is little time to open a box, locate a wrench and tighten the hoses to the cylinders. On the other hand, if the kit is opened and the hoses attached, then the hoses and dispensing gun are permanently outside the box and exposed to the environment where damage can occur.

SUMMARY OF THE INVENTION

Accordingly it is a principal object of the invention to provide an improved box, package or carton for housing a two-component polyurethane froth foam kit which is ready for use when opened and does not require opening and closing a cover to access valves to use the kit.

This object along with other features of the present invention is achieved in a carton for shipping and storing a two-component polyurethane foam spray kit including two pressurized cylinders, a dispensing gun and a hose for each cylinder connected to one of the cylinders and the gun. The carton is folded from a one-piece corrugated cardboard blank into a unitary structure and includes a front and a rear panel interconnected at their ends with first and second side and bottom sections depending respectively from the first panel, the second panel and the first and second side to form, when folded, the bottom of the carton. A top cover flap extends from one of the front and real panels for closing the carton and the top cover flap has first and second valve openings permitting the user of the kit to open and close the valves on the cylinders. The top cover flap has a partially filled center opening and a strap handle connects the cylinders and extends through the center opening whereby the user of the kit does not have to open or close a flap for turning on or off the valves while the carrying strap, being directly connected to the cylinders which comprise substantially all the weight of the kit, allows the carton to carry the lighter components of the kit notwithstanding any weakening or deterioration of the corrugated cardboard.

In accordance with another aspect of the invention, a closeable, punch-out front flap formed as part of the front panel is provided for gaining access, when the flap is opened, to the hoses and dispensing gun when the kit is used. When the kit is stored or shipped, the hoses, in coiled form, secured to the cylinders and the dispensing gun are contained within the carton when the flap is closed whereby the hoses and gun can be stored in the box. The necessity of a tray for holding the hoses and the gun is alleviated and the kit can be assembled at the factory in a ready-to-use condition. Optionally, the closeable front flap is perforated and dimensioned to allow the user, at the user's option, to discard the front flap while still retaining the ability to store the hoses and gun between cylinders and the carton's front panel.

In accordance with another feature of the invention, the carton further includes a side flap extending from the top of each side section which is folded between the crowns of the cylinders and the top flap. Each side flap has a crown opening in registry with a valve opening in the top flap to allow access to the cylinder's valve without opening the carton. Each side flap is foldable, when the carton is assembled, to provide two ply thickness between the top of the crown and the top flap whereby the rigidity of the box is significantly increased for stacking purposes since the cylinders themselves are integrated into the carton.

In accordance with another aspect of the invention, the carton has an outer disposable cover flap extending from the other one of the front and rear panels opposite the panel from which the top flap extends. The outer cover flap has a filled foldable central opening aligned with the center opening of the top flap and through which the carrying strap extends when the outer cover is folded over the top flap in the shipped condition of the carton whereby the top of the carton is completely covered during shipping while providing two ply carton thickness supported by a cylinder crown in each cylinder for stacking purposes. When opened, the outer cover can be torn away and discarded so that access to the valve openings can always be had without opening the carton, or the cover can be left attached to the box at user discretion.

It is thus an object of the invention to provide an improved box, carton or container for a two-component polyurethane spray kit which does not require the hoses to be attached by the end user to the cylinders prior to use.

It is another object of the invention to provide an improved, box, carton or container for a two-component polyurethane spray kit which is structurally stronger than existing two-component polyurethane spray cartons.

Yet another important object of the invention is to provide an improved box, carton or container formed as a folding container for a two-component polyurethane foam kit which does not require the carton top to be opened or closed to use the kit.

Still yet another specific object of the invention is to provide an improved box, carton or container for holding a two-component polyurethane spray foam kit in a mining environment.

It is an object of the invention to provide a carton, box or container for containing a two-component polyurethane foam kit in which the cylinders contained within the box are connected and lifted together by a strap extending through the box so that the hoses, cylinders and dispensing gun contained within the box can be carried to a desired location irrespective of the structural condition or deterioration of the box resulting from moisture or water in the mine or other environmental conditions.

It is an important object of the invention to provide a carton for a two-component polyurethane foam kit which makes the kit easy to use in that the carton allows or provides for one or more of the following:

a) the cylinders are carried upright so that the box does not have to be upended to gain access to opening and closing the cylinder valves;

b) a box cover or flap does not have to be opened to gain access to the valves;

c) the kit is shipped ready to use and requires no field assembly so no cross-threading or leakage at the hose fittings occurs;

d) after initial use, the hoses and gun can be easily stored within the box without disassembly so damage to the hoses and gun after initial use is less likely to occur, and e) if the outside environment wets the carton or otherwise causes deterioration of the carton structure to the point where conventional cartons are no longer suitable for carrying the cylinders, the carton still functions to allow the kit to be hand carried to the desired location.

Still another object of the invention is to provide an improved carton for a two-component polyurethane foam kit which integrates a multi-ply cardboard structure with the kit cylinders such that the metal cylinders provide structural stacking support for the carton.

Still another object of the invention is to provide an improved box for a two-component polyurethane foam kit which is inexpensive while having structural rigidity sufficient to meet applicable shipping codes and regulations.

These and other objects, features and advantages of the present invention will become apparent to those skilled in the art upon reading and understanding the Detailed Description of the Invention set forth below taken in conjunction with the drawings.

BRIEF DESCRIPTION OF THE DRAWINGS

The invention may take form in certain parts and an arrangement of certain parts taken together and in conjunction with the attached drawings which form a part hereof and wherein:

FIG. 8 is a pictorial representation of a portion of the box with the carrying strap secured to the cylinders;

FIGS. 9A and 9B are plan views of a conventional strap used in the present invention;

FIG. 10 is a pictorial view of the box with the top cover flap and removable cover flap opened;

DETAILED DESCRIPTION OF THE INVENTION

Figure 1:
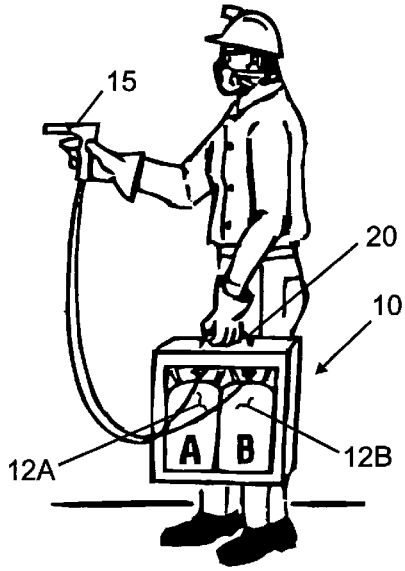
FIG. 1 is a pictorial depiction of the use of the portable polyurethane foam kit with the front of the carton broken away to show the cylinders.

Referring now to the drawings wherein the showings are for the purpose of illustrating a preferred embodiment of the invention only and not for the purpose of limiting same, there is shown in FIG. 1 a two-component portable polyurethane foam spray kit contained within a carton 10 which has its front panel broken away for illustration purposes. It is to be understood that the words "carton", "container", "box" are, for purposes of this description, identical and are used interchangeably throughout the specification in describing the "package" or carton 10 which contains the two-component polyurethane foam spray kit. Further, the "kit" may or may not include carton 10.

The portable two-component polyurethane foam kit includes two cylinders 12, typically an "A" cylinder, 12A, which contains a polymeric isocyanate and a "B" cylinder, 12B, which contains a polyol amine or resin. Formulations within each cylinder can vary significantly depending on the application. For example, adhesive applications produce a polyurethane foam which has very little, if any, "foam" while insulation applications use a formulation which produces a significant rise in the foam. Usually, portable, hand carried two-component polyurethane foam kits dispense the chemicals from the dispensing gun as a "froth" having a consistency or texture similar to that dispensed from an aerosol can of shaving cream. All such variations in the formulations of polyurethane and whether the chemicals are dispensed as a spray or froth are included within the scope of the present invention so long as the formulations are supplied in a portable, hand carried kit form.

Typically, the cylinders are standard, pressurized vessels generally designated by cylinder diameter. In the preferred embodiment, the cylinder diameter is 7½" although two-component polyurethane foam kits are supplied with cylinders varying anywhere from about 6 to 10" in diameter. Generally, the cylinders weigh anywhere from 15 to about 30 lbs. and are pressurized with an inert gas, generally nitrogen, at pressures of about 200 psi gage at ambient temperature, 70° F. The formulations are such that equal amounts or ratios of "A" and "B" are used in dispensing the foam. While the invention is limited to two cylinders, it is not limited to any specific cylinder size.

Each cylinder 12 has a valved fitting to which a hose 14 is connected at one end thereof, there being a hose 14A for "A" cylinder 12A and a hose 14B for "B" cylinder 12B. Each hose, 14A, 14B is connected at its opposite end to a dispensing gun 15. Dispensing gun 15 is typically a fixed ratio gun molded from plastic. An example of such gun can be found in assignee's U.S. Pat. No. 5,242,115 to Brown, entitled "Apparatus and Method for Mixing and Dispensing and Mixing Nozzle Therefore" (incorporated by reference herein) for a description of a dispensing gun used in atwo-component system. The invention, however, is not limited to any specific dispensing gun design.

Figure 2:
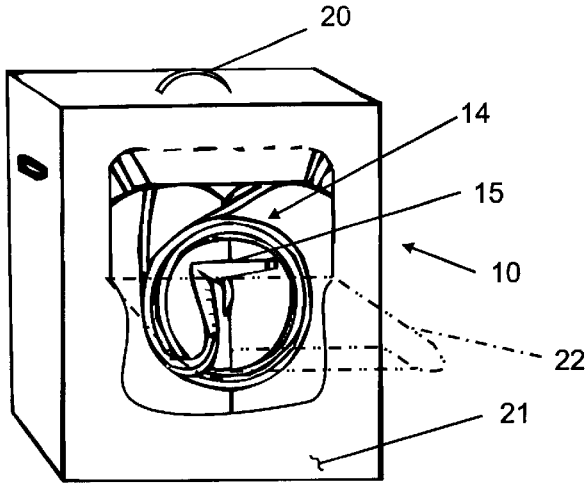
FIG. 2 is a pictorial representation of the carton of the subject invention with a portion of the front broken away to show the stored position of the kit components.
Figure 3:
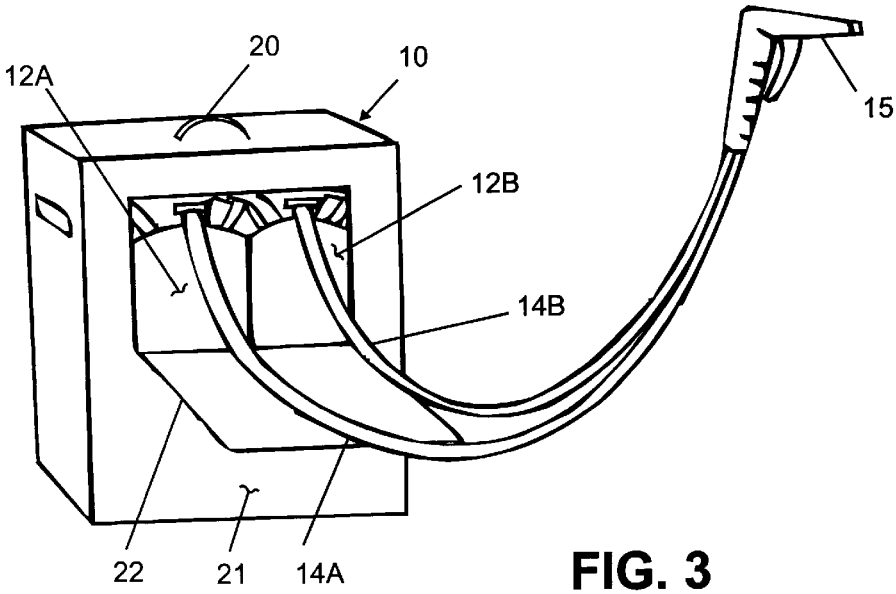
FIG. 3 is a pictorial representation of the carton similar to FIG. 2 but showing the hoses uncoiled with the kit ready to use.

FIG. 1 shows a miner, in the preferred embodiment, dispensing the foam and the illustration is primarily included to show that cylinders 12A, 12B are upright in carton 10 when the kit is in use and the miner easily holds carton 10 and the kit components by means of a conventional strap 20. Referring now to FIG. 2, the polyurethane foam kit with a portion of its front panel broken away is shown with its components in a stored condition. In this position, hoses 14, which as noted are shipped attached to cylinders 12 and dispensing gun 15 are stored in a coiled position as shown between the cylinders and the inside surface of a front panel 21 of carton 10. As will be explained later, front panel 21 has a recloseable, punch-out front flap which is shown in dot-dot-dash phantom line 22 in FIG. 2 for illustration purposes only. FIG. 2 shows that the hose can be stored in carton 10 after the carton is opened should front flap 22 be removed from carton 10. Referring now to FIG. 3, the kit is shown in its condition ready for use as in FIG. 1. In this condition, recloseable, punch-out front flap 22 is opened and hoses 14 are uncoiled and dispensing gun 15 is drawn out of carton 10.

Figure 4:
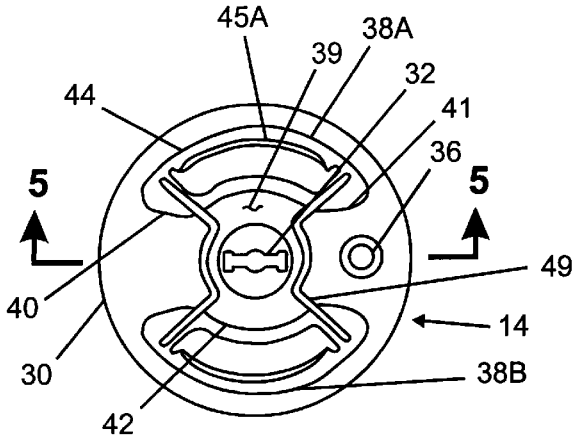
FIG. 4 is a top view of a conventional cylinder used in the polyurethane foam spray kit.
Figure 5:
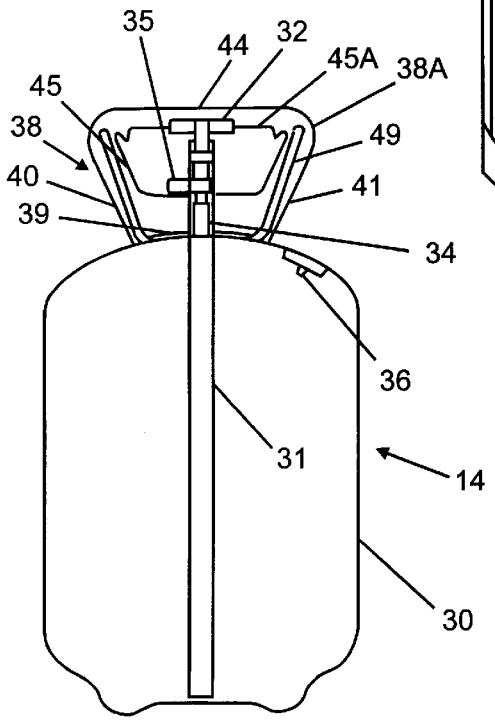
FIG. 5 is a side elevation of the conventional cylinder shown in FIG. 4 taken along lines 5—5.

Referring now to FIGS. 4 and 5, there is shown cylinder 14 which is entirely conventional. Cylinder 14 has a pressurized cylindrical body 30 and a dip tube 31 extends into body 30 to a position close to the bottom thereof. Secured to dip tube 31 is a valve 32 which rotates a valve stem 34 within dip tube 31 which in turn opens and closes fluid communication of tube 31 with a hose fitting 35. In the design illustrated, 14 is charged with the "A" or "B" components through dip tube 31. Other valving arrangements can be employed. A pressure relief 36 is provided for cylinder 14 in accordance with safety regulations.

Extending upwardly from cylindrical body 30 is a guard or crown 38 which is stamped from sheet metal and spot or resistance welded to the top of cylindrical base 30. In the preferred embodiment, crown 38 can be viewed as including two, identical fan-shaped guard sections 38A, 38B which extend upwardly from a concave, circular base 39 in turn secured, as stated, to cylindrical body 30. Each guard section 38A, 38B extends between first and second side edges 40,41 from an arcuate base line 42 to an arcuate top edge 44. In the preferred embodiment arcuate top edge 44 and base line 42 are circular arcs extending slightly more than 90 degrees, although the arcs need not be circular and can extend, in theory, to 180 degrees. Side edges 40, 41 are canted outwardly from base line 42 towards the O.D. of cylindrical body 30 so that if guard sections 38A, 38B were extended to contact one another, a funnel would result. Within each guard section 38A, 38B is a fan-shaped opening defined by an inner edge 45 which can be viewed as dividing each guard section into an arcuate top segment 46 and an arcuate bottom segment 47 (FIG. 5). The fan shaped opening is provided as a lifting opening for carrying cylinder 14. Because guards 38A, 38B, are sheet metal, the upper part of inner edge 45 (i.e. ,the lifting opening) has a portion of the sheet metal folded back or crimped about the edge as designated by reference numeral 45A (FIG. 4) to avoid a cutting edge that would otherwise occur while carrying cylinder 14. Finally, crown 38 is stamped with ribs, designated by reference numeral 49, in circular base 39 and guards sections 38A, 38B for strengthening purposes.

Crown 38 is a guard or shroud that protects valve 32 from damage during shipment and is one way of meeting certain safety regulations controlling shipment of pressurized containers applicable to "A" and "B" cylinders 14A, 14B. The particular crown 38 described, in detail with reference to FIGS. 4 and 5 is specific to a given cylinder manufacturer. Other guard or crown configurations are and can be used with the present invention so long as the guard defines a wall or shield spaced from valve 32 which extends upwardly from cylinder 14 and has a window through which a carrying or lifting strap can be secured. The guards do not have to be arcuate nor funnel shaped.

Figure 6:
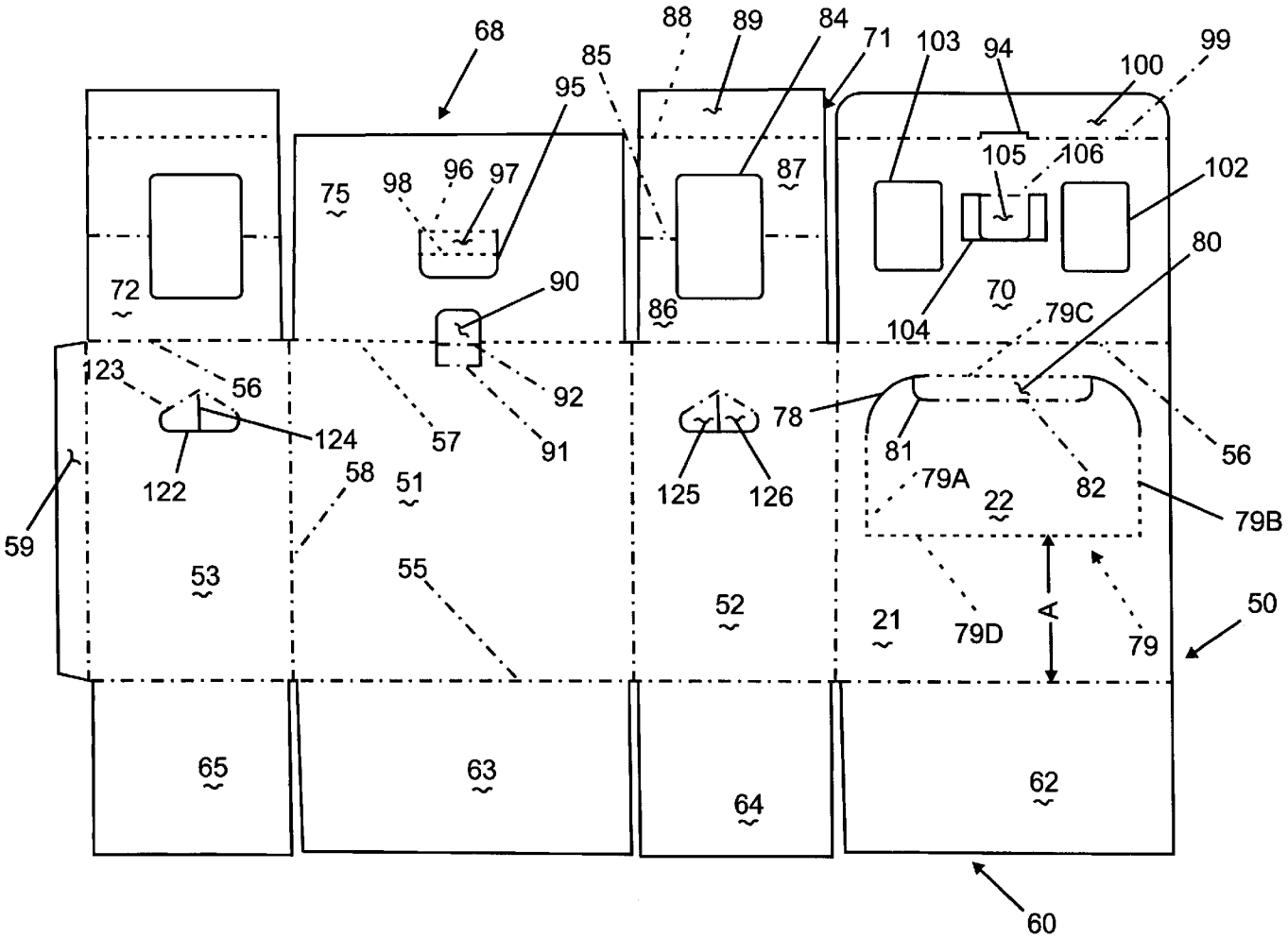
FIG. 6 is a plan view of the corrugated cardboard blank from which the carton of the present invention is formed.

Referring now to FIG. 6, there is shown a single corrugated cardboard blank 50 which, when folded, results in carton 10 of the present invention. For consistency in terminology, blank 50 will be described as having certain defined sections while box 10 will have the same components but without the designation "sections" added to the element. For example, box 10 has already been stated to have a front panel 21 which will be referred to as font panel section 21 when describing blank 50. Also, with reference to FIG. 6, solid lines are cut lines, dash-dot lines are fold lines and dash lines means the blank is cut with perforations or spaced cuts, i.e., a perforated cut line about which the cardboard can be folded (and left in place) or torn from blank 50. Further, the words "top", "bottom", "right-hand" and "left-hand", when used in the Description and in the claims, are used in a relative sense of orientation to distinguish one box section or component from another and are not necessarily used in an absolute, directional sense.

Blank 50 has a front panel section 21, a rear panel section 51, a first or left hand side section 52 and a second or right-hand side section 53. Each section 21, 51, 52, 53 extends upwardly from a common bottom horizontal fold line 55. Front panel section 21 and first and second side sections 52, 53 extend downwardly from a common top horizontal fold line 56. Rear panel section extends downwardly from a top perforated cut line 57 which is coincident with top horizontal fold line 56. The space between vertical fold lines 58 define the depth distance of side sections 52, 53 and the width distances of front and rear panel sections 21, 51. A glue flap 59 extends from second side section 53, the exterior surface of which is glued to the interior of front panel 21 when box 10 is assembled.

Extending downward from bottom horizontal fold line 55 to the bottom edge of blank 50 designated by reference numeral 60 is a base front section 62, a base rear section 63, a first base side section 64 and a second base side section 65. Extending from top horizontal folding line 56 to the top edge of blank 50 designated by reference numeral 68 is a top flap section 70, a first or left hand side flap section 71 and a second or right hand side flap section 72. Extending upwardly from top perforated cut line 57 to top edge 68 of blank 50 is a disposable cover flap 75.

A closeable or recloseable front flap section 22 is provided in front panel section 21.

Front flap section 22 is generally rectangular with slitted upper corners designated by reference numeral 78 and a perforated cut line designated by reference numeral 79 defining its shape by side line perforations 79A, 79B, top line perforations 79C and bottom line perforations 79D. A front locking tab 80 defined by slitted side comers 81 and a horizontal tab fold line 82 extends over a top portion of front flap section 22. Front flap section 22 is opened by punching in the side and top perforations adjacent slitted side comers 81 permitting front flap section 22 to pivot about bottom line perforations 79D. Front locking tab 80 folds relative to front flap section 22 so that pushing front flap section 22 back into front panel section 21 holds front flap section 22 generally co-planar with the face of front panel section 21. This construction is conventional. For a consumer example of a similar concept, see the back of a Q-Tip® box. Bottom line perforations 79D are provided so that the kit user can optionally discard front flap section 22. There is sufficient dimensional distance between bottom line perforations 79D and common horizontal fold line 55 (i.e., the base of carton 10) designated by reference dimension "A" to store hoses 14 and gun 15 between cylinders 12 and front panel 21 with front flap section 22 removed. Alternatively, the kit user can leave front flap section 22 as part of carton 10. Front flap 22 is the structure used to gain access to hoses 14 and dispensing gun 15. It obviates the need for a separate tray. It is formed as shown so that front panel 21 is entirely closed during shipping. In use, front flap 22 can be discarded or retained. In either instance, hoses and gun can be stored within carton 10 when not in use.

Each side flap section 71, 72 is identical so that a description of left hand side flap section 71 will likewise apply to right hand side flap section 72. Side flap section 71 has a crown opening defined by a rectangular cut line 84. A side top fold line 85 divides side flap sections 71 into a first side fold section 86 adjacent side section 52 and a second side fold section 87 adjacent first side fold section 86 extending towards top edge 68. A horizontal side flap perforated cut line 88 adjacent second side fold section 87 and spaced from top edge 68 defines a side flap spacer section 89.

Rear panel section 51 has a locking tab section 90 extending from the top thereof. Locking tab has a base fold line 91 and a center fold line 92 permitting locking tab section 90 to be bent for insertion into a tab opening 94 in top flap section 70.

Disposable cover flap section 75 has a central opening defined by a cut line 95 and a horizontal perforated cut line 96. Filling central opening is a central tab section 97 and a center horizontal perforated cut line 98 allows central tab section to be folded back over itself exposing a portion of the central opening.

Top flap section 70 has a top flap horizontal fold line 99 defining a foldable lip section 100 extending between top edge 68 and horizontal fold section 99. Rectangular line cuts 102, 103 define, respectively, first and second valve openings. First and second valve openings are in registry or in alignment with the crown opening formed by cut line 84 in first and second side flap sections 71, 72, respectively when blank 50 is folded. A center cut line 104 which is formed as a part of a rectangle defines a center opening in top flap section 70 which is in registry or alignment with central opening in disposable cover section 75 when box 10 is assembled. Extending within center opening is a top tab section 105 which extends from a tab fold line 106 co-linear with a portion of cut line 104. When top tab section 105 is bent about tab fold line 106 the complete rectangular center opening is opened for pulling strap 20 therethrough.

Completing the description of blank 50, punch out hand openings are formed in first and second sides 52, 53 of carton 10. Each hand opening is defined by a side cut line 122 merging into a hand opening fold line 123 in the shape of a triangular apex as shown. A vertical side cut line 124 extends from the apex of fold line 123 to side cut line 122 so that when the hand opening is punched out on side cut line 124, first and second side fold-outs 125, 126 which occupied the space of the hand opening are folded back into the carton.

Figure 7:
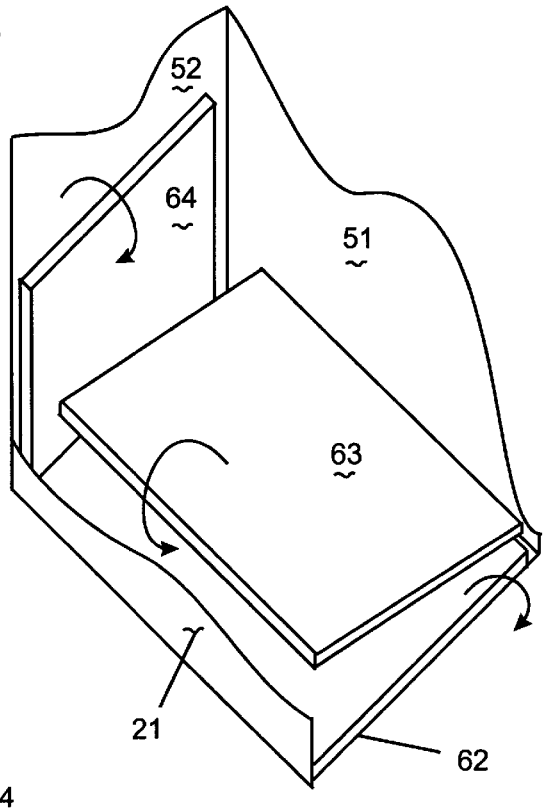
FIG. 7 is a pictorial representation of some of the base sections of the carton folded to make the bottom of the carton.

Carton 10 and the polyurethane foam spray kit are assembled by initially folding blank 50 about vertical fold lines 58 and adhesively securing glue flap 59 to the inside surface of front panel 21. Alternatively glue flap 59 could extend from front panel 21 and be secured to rear panel 51. A rectangular enclosure now results. The bottom of carton 10 is formed by folding base front 62, base rear 63, first base side 64 and second base side 65 as shown in FIG. 7. This construction provides a three ply bottom thickness formed of base front 62, base rear 63 and one of the base sides 64, 65. The lowest most base section, shown as base front 62, is glued or preferably taped to the opposing panel, i.e., rear panel 51 shown in FIG. 7, to prevent the lowest most base section from opening. It is preferred that carton 10 have a three ply base for mining applications which generally result in the lower part of carton 10 becoming wet when the kit is left in standing water. However, other bottom box constructions can be employed. For example, first and second base sides 64, 65 could be made integral with base front 62 and bendable about fold lines where they join with base front 62. This results in a conventional box structure not requiring any tape or adhesive to secure base front 62 to rear panel 51 because base sides remain parallel with the carton sides to hold base rear 63 in place. This conventional box construction produces a weaker bottom than that shown in the preferred embodiment because the side bases have to remain upright to support the base rear bottom 63.

With the bottom of carton 10 assembled, cylinders 12A, 12B with hoses 14A, 14B connected to cylinder and dispensing gun 15 are placed into carton 10. The hoses are coiled and fit between front panel 21 and cylinders 12 as shown in FIG. 2. In this regard, it has been found that the cylinders are oftentimes rotated as the hoses and gun are fitted into their shipped position within carton 10. That is sides 52, 53 are nominally dimensioned about an inch greater than the diameter of cylinders 12 to permit coiled hoses 14A, 14B to fit between front panel 21 and cylinders 12 and provide a snug but not tight fit. Rotating the cylinders moves hose fitting 35 allowing the hose coil to somewhat easily fit into the space. A conventional plastic carrying strap 20 is next affixed to both cylinders 12A, 12B through the crown windows in crown 38 as shown in FIG. 8.

Figure 11:
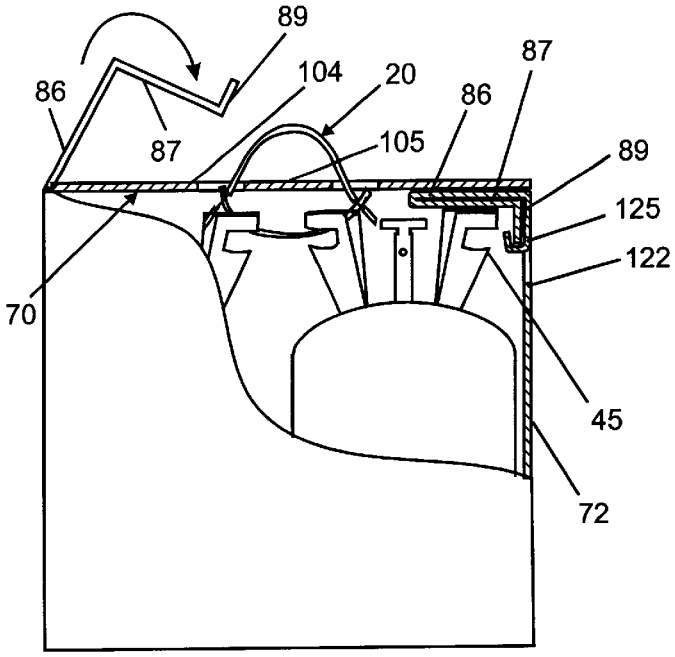
FIG. 11 is a front view of the carton with portions of the carton broken away to show the folded position of the side flap of the carton.

Referring now to FIGS. 9A and 9B a two piece conventional strap 20 is shown. Strap 20 has a male section 20A with a necked down portion 110 at each end received within a slot 112 formed at each end in a female section 20B. As best shown in FIG. 8, one of these sections, male section 20A extends through the fan shaped opening adjacent edge section 45A of both cylinders 12A, 12B and its necked down portions 110 fitted into slots 112 of female section 20B to form the carrying strap. FIG. 11 shows carrying strap 20 applied with female section extending through fan shaped opening 45 in crowns 38. Strap 20 is not attached to any part of carton 10.

Referring now to FIG. 11, there is shown the next step in assembling the kit which is to fold first or left-hand side flap 71 and second or right hand side flap 72 into carton 10. Specifically, second fold section 87 is folded under first fold section 86 and flap spacer section 89 is folded at 90° relative to second fold section 87. First fold section 86 is then rotated about horizontal fold line 56 so that flap spacer section 89 rests against the inside surface of side wall 52, 53. Sides 52, 53 are thus connected by side flaps 71, 72 to cylinders 14. When cartons 10 are stacked during shipment, weight is transferred to cylinders 12. When hand openings are punched out on cut line 122, side fold outs 125, 126 fold about spacer section 89. Spacer section 89 provides some thickness to the hand openings and adds some strength because spacer section 89 is in contact with top flap 70 vis-a-vis first and second fold sections 86, 87.

Figure 12:
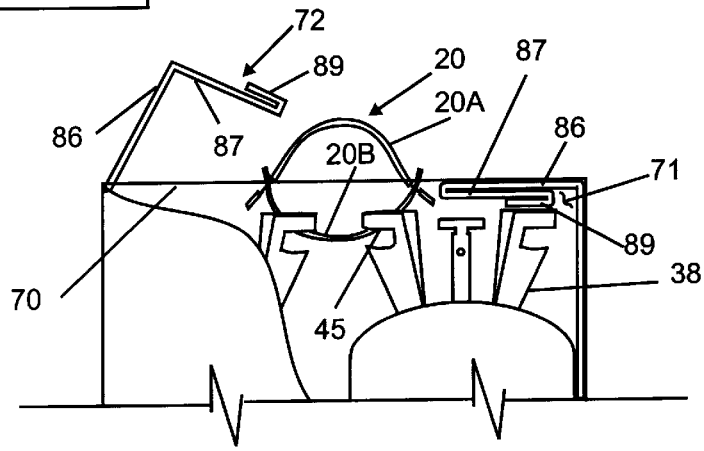
FIG. 12 is a view similar to FIG. 11 showing an alternative embodiment of the side flap.

Referring now to FIG. 12, there is shown an alternative embodiment for folding first and second side flaps 71, 72. In FIG. 12, second fold section 87 is folded under first fold section 86 and flap spacer section 89 is folded under second fold section 87. First fold section 86 is then rotated about horizontal fold line 56 so that flap spacer section 89 rests on top edge 46 of the guard closet to a side wall. Sides 52, 53 are thus connected by side flaps 71, 72 to cylinders 14. In connection with this alternative embodiment, side fold-outs 125, 126 (i.e., hand openings) can be dimensioned to fit within the fan opening of guard 38A adjacent the carton side so that it contacts folded over edge 45A of the guard. In this alternative embodiment, when carton 10 is carried by its hand openings, the user is actually lifting each cylinder through the fan shaped opening of the guard.

Figure 13:
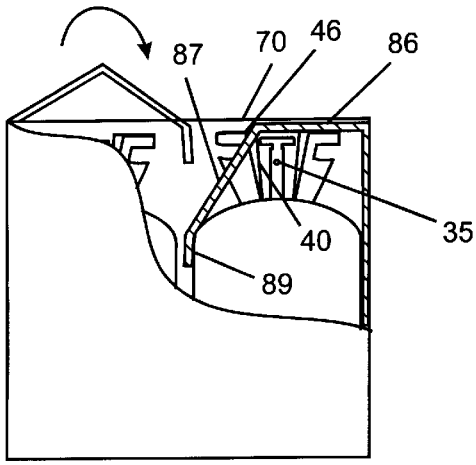
FIGS. 13 and 14 are partial side and top views, respectively, of an alternative embodiment of the side flap of carton.
Figure 14:
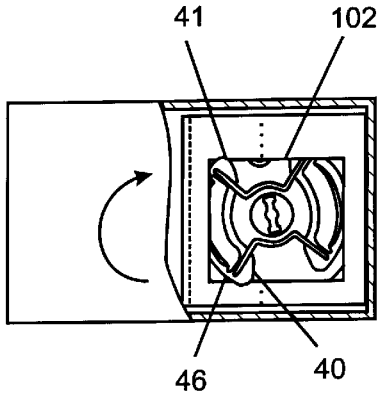

A still further alternative embodiment of side flaps 71, 72 is illustrated in FIGS. 13 and 14. In this embodiment, second fold section 87 is folded downwardly towards the bottom of carton 10 after first fold section 86 is rotated to contact top edge 46 of the guard nearest the side. The valve opening in side flap for second fold section 87 passes beneath top edge 46 of the other guard 38A and in this connection, cylinder 14 is rotated so that arcuate top edge 46 passes within valve opening. Spacer section 89 now extends between cylinders 12. Once the side flap is positioned as shown in FIG. 13 the cylinders are rotated as shown in FIG. 14 so that side edges 40,41 contact or distort valve opening edge surface 102. This alternative positioning of the carton side flaps 71, 72 would be used if shipping regulations now in force were changed to require that the package for transporting cylinders prevent metal-to-metal contact between cylinders and/or required the cylinders to be rigidly positioned within the carton. It is not used for the preferred embodiment because, as noted, it is desired that the cylinders be rotatable for positioning the hoses within carton 10 during assembly. If metal-to-metal contact is not a concern, then spacer section 89 can be eliminated from side flaps 71, 72. This would avoid any contact with stored coiled hoses.

The kit assembly, ready for shipment, is completed by closing top flap 70 over the folded side flaps 71, 72 and closing disposable cover 75 over top flap 70 as best shown in FIG. 10. Top flap 70 is rotated about top horizontal fold line 56 after lip 99 has been folded about top flap horizontal fold line 99 until lip 100 fits against the interior surface of front panel 21. Locking tab 91 is then folded into tab opening 94 to lock top flap 70 to front panel 21. While locking tab 91 securely holds top flap 70 in its closed position in carton 10, top flap is not used in any significant manner to lift the contents of carton 10. That is, when carton 10 is carried by strap 20, cylinder crowns 38 contact folded side flaps 71, 72 which are in contact with top flap 70. Locking tab 91 is only used to hold carton 10 and carry the weight of hoses 14 and dispensing gun 15. Top flap tab 105 is lifted and strap 110 pulled through center opening after which top flap tab 105 is inserted back into center opening so that strap 110 extends through center opening on either side of top flap tab 105. Central tab 97 on cover 75 is now folded back onto itself through second tab perforated cut line 97.

Disposable cover 75 is then rotated about top horizontal perforated cut line 57 to rest on top flap 70. Disposable cover 75 is secured to carton 10 by adhesive or in the preferred embodiment by simply taping disposable cover 75 to rear panel 51. Strap 110 is now pulled through central opening in the space opening provided when central tab 97 is folded on cut line 98. After strap 100 is through central opening, central tab 97 is pushed flat forcing the strap between central opening cut line 95 and central tab 97 and closing any opening in the top of carton 10 caused by strap 110. Thus carton 10 is completely sealed in accordance with shipping requirements while strap 110 is secured to cylinders placed in carton 10.

The carton used in the polyurethane foam kit of the present invention has been described with reference to a preferred embodiment. The carton utilizes the cylinders to improve the carton strength and rigidity while making use of somewhat conventional folding cardboard box techniques to provide a rigid foldable box. For example a strong three ply bottom construction was chosen and the top has a two ply thickness. The side flaps are used to significantly increase columnar strength of the carton by contact with the cylinders and even the side openings can be designed to grasp the cylinders for carrying purposes. Significantly the strap is not connected to the box bottom or top but is directly connected to the cylinders which comprise almost all the weight of the kit. Thus the structural integrity of the box is used to carry the weight of the hoses, gun and box but not the cylinders. The box is more or less along for the ride and not providing the ride. At the same time, cover and top flap openings with movable tab sections are provided for the strap to enter the box without any openings being present in the box so that no foreign material can enter the carton during transit. Perhaps as significant as any of these features are the convenience features built into the carton to allow easy use of the two-component polyurethane spray kit. Flaps do not have to be opened or closed to turn on and off the cylinders. Hoses do not have to be installed by the end user. The closeable and/or removable front panel flap, again employing a technique known in the cardboard box trade to close the flap, was utilized so that the hoses and gun did not have to be stored at the top or bottom end of the box. The hoses can be stored in the attached condition against the front panel so long as access to the kit could be provided vis-a-vis the closeable front flap and further, the closeable front flap could be discarded after opening, with dimensioning sufficient to store the hoses coiled in the box. In either instance, with or without the front flap, the kit user is able to store the hoses inside the box after use where they or the dispensing gun can not be damaged by being left outside the box as is now the current practice. All of these features as well as other advantages and features which are apparent or obvious to those skilled in the art upon reading and understanding the Detailed Description of the Invention set forth above are intended to be included within the scope of the present invention.

Having thus defined the invention, it is claimed:

1. A carton for shipping and storing a two-component polyurethane foam spray kit including two pressurized cylinders, a dispensing gun and a hose for each cylinder connected to one of the cylinders and said gun, said carton folded from a cardboard blank into a unitary structure comprising:

a front and a rear panel interconnected at their vertically extending ends with first and second sides to form a rectangular opening when said blank is folded;

bottom sections depending from at least said front and rear panels to form a carton bottom when said blank is folded;

a top flap extending from one of said front and rear panels for closing said carton, said top flap having first and second valve openings for permitting the user of said kit to open and close the valves on said cylinders, said top flap having a partially closed center opening;

a strap handle connecting said cylinders and extending through said center opening for carrying said carton; and said hoses being connected to said cylinders and said gun and coiled with said gun between said front panel and said cylinders when said kit is shipped.

2. The carton of claim 1 further including a closeable, punch-out front flap formed as part of said front panel for gaining access, when said front flap is opened, to said hoses and dispensing gun when said kit is used and for storing said hoses in coiled form with said gun totally enclosed within said container when said front flap is closed.

3. The carton of claim 2 further including a side flap extending from the top of each side, each side flap having a crown opening therein in registry with said valve opening in said top flap when said side flap is folded between said front and rear panels and said top flap is folded over said side flap; each side flap folded from its unattached end back onto itself when the box is assembled to form at least a side flap of two ply thickness in contact with the top of the cylinder's crown and the underside of said top flap whereby the cylinders provide additional columnar strength for the carton for stacking purposes during shipment.

4. The carton of claim 3 wherein each side flap extends between said front and rear panels and has a horizontal perforated cut line adjacent to but spaced from the free end of said side flap defining a spacer segment of said side flap, each side flap having side fold lines extending from said crown opening to the edges of said side flap adjacent said front and rear panels whereby said spacer segment is folded back onto said side flap and said side flap is folded back onto itself about said side fold lines to form a three ply thick side flap in contact with the top of the crown of said cylinders and the underside of said top flap; and each side wall having punch-out handle portions formed adjacent the top end of said side for carrying said carton in lieu of said strap, said punch out portions folded about a portion of an opening formed in the crown of the cylinders whereby said carton and said cylinders are simultaneously carried through said handle portions.

5. The carton of claim 3 further including an outer disposable cover flap extending from the other one of said front and rear panels, said outer cover flap having a filled central opening aligned with said center opening and through which said strap extends when said outer cover is folded over said top flap whereby said valve openings are closed within said carton during shipping while providing a two ply carton top supported by the crowns of the cylinders for stacking purposes.

6. The carton of claim 5 wherein said center opening of said top flap is generally rectangular with a top tab extending from a fold line at an opening edge adjacent one of the panels to a center opening edge adjacent the other one of said panels partially filling said center opening; said overlying central opening in said cover flap being generally rectangular with a cover tab substantially filling said central opening and extending from a perforated cut central opening edge adjacent one of the panels, said cover tab having a second perforated cut line extending across said cover tab in the direction of said sides whereby said strap connected to both cylinders extends through said center opening in said top flap between said top tab and through said central opening space when said cover tab is folded about said second cover perforated cut line in said cover tab, said cover tab folded flat with the strap sections between edges of said central opening and central tab whereby the top of said carton is completely sealed without openings when said carton is shipped.

7. The carton of claim 2 wherein said front flap has a bottom horizontal perforated cut line about which said front flap rotates to open and close said front panel of said carton, said bottom horizontal perforated cut line spaced from the bottom of said carton a distance sufficient to store said hoses in coiled form with said gun between said cylinders and the interior of said front panel should the kit user decide to tear off said front flap.

8. The carton of claim 7 wherein said crown of each cylinder includes two fan shaped guards extending upwardly from the top of said cylinder, each guard having an arcuate top edge extending no more than about 180 degrees between two, upwardly extending side edges defining a fan shaped configuration of said guard and each guard having a fan shaped opening spaced below said top edge for carrying said cylinder; said side flap having a first portion adjacent said side wall resting on said top edge of one of said guards and a second portion extending downwardly towards the carton bottom, said crown opening dimensioned such that said side edges of said guard deform said crown opening in said second portion at a point below said top edge when said cylinder is rotated to have its valve pointed towards said front panel after said side flap's second portion has been folded downwardly into said carton.

9. The carton of claim 3 wherein each side flap extends between said front and rear panels and has a horizontal perforated cut line adjacent to but spaced from the free end of said side flap defining a spacer segment of said side flap, each side flap having side fold lines extending from said crown opening to the edges of said side flap adjacent said front and rear panels whereby said side flap is folded back onto itself about said side fold lines to form a two ply thick side flap in contact with the top of the crown of said cylinders and the underside of said top flap with said spacer segment adjacent the interior surface of a side wall and said side having punch-out hand openings formed adjacent the top end of said side for carrying said carton in lieu of said strap, the punch-out portions of each side opening folded about said spacer segment.

10. A portable, two-component polyurethane foam kit including two pressurized cylinders, one cylinder containing a resin and the other cylinder containing isocyanate, a dispensing gun, a hose for each container able to be connected at one end to a container and at its other end to said dispensing gun and a carton formed from corrugated cardboard for carrying said cylinders, hoses and gun, said carton comprising:

a front and a rear panel interconnected at their vertically extending ends with first and second sides to form a rectangular opening when said blank is folded;

bottom sections depending from at least said front and rear panels to form a carton bottom when said blank is folded;

a top cover flap extending from one of said front and real panels for closing said carton, said top cover flap having first and second valve openings for permitting the user of said kit to open and close the valves on said cylinders, said top cover flap having a partially closed center opening;

a strap handle connecting said cylinders and extending through said center opening for carrying said carton; and a closeable, punch-out front flap formed as part of said front panel for gaining access, when said flap is opened to said hoses and dispensing gun when said kit is used.

11. The kit of claim 10 wherein said hoses are connected to said cylinders and said gun and coiled with said gun between said front panel and said cylinders when said kit is shipped.

12. The kit of claim 11 further including a side flap extending from the top of each side, each side flap having a crown opening therein in registry with a valve opening in said top flap when said side flap is folded between said front and rear panels and said top flap is folded over said side flap; each side flap folded from its unattached end back onto itself when the box is assembled to form a side flap of at least two ply thickness in contact with the top of the cylinder's crown and the underside of said top flap whereby the cylinders provide additional columnar strength for the carton for stacking purposes during shipment.

13. The kit of claim 12 wherein each side flap extends between said front and rear panels and has a horizontal perforated cut line adjacent to but spaced from the free end of said side flap defining a spacer segment of said side flap, each side flap having side fold lines extending from said crown opening to the edges of said side flap adjacent said front and rear panels whereby said side flap is folded back onto itself and said spacer is folded against said side; and each side having a punch out hand opening adjacent the top end of each side for carrying said carton in lieu of said strap, the punch out portion of each opening folded about said spacer segment.

14. The carton of claim 13 further including an outer disposable cover flap extending from the other one of said front and rear panels, said outer cover flap having a filled central opening aligned with said center opening and through which said strap extends when said outer cover is folded over said top flap whereby said valve openings are closed within said carton during shipping while providing a two ply carton top supported by the crowns of the cylinders for stacking purposes.

15. The carton of claim 14 wherein said center opening of said top flap is generally rectangular with a top tab extending from a fold line at an opening edge adjacent one of the panels to a center opening edge adjacent the other one of said panels partially filling said center opening; said overlying central opening in said cover flap being generally rectangular with a cover tab substantially filling said central opening and extending from a perforated cut central opening edge adjacent one of the panels, said cover tab having a second perforated cut line extending across said cover tab in the direction of said sides whereby said strap connected to both cylinders extends through said center opening in said top flap between said top tab and through said central opening space when said cover tab is folded about said second cover perforated cut line in said cover tab, said cover tab folded flat with the strap sections between edges of said central opening and central tab whereby the top of said carton is completely sealed without openings when said carton is shipped.

16. The carton of claim 15 wherein said front flap has a bottom horizontal perforated cut line about which said front flap rotates to open and close said front panel of said carton, said bottom horizontal perforated cut line spaced from the bottom of said carton a distance sufficient to store said hoses in coiled form with said gun between said cylinders and the interior of said front panel should the kit user decide to tear off said front flap.

17. The carton of claim 12 further including each side wall having punch-out hand openings formed adjacent the top end of said sides for carrying said carton in lieu of said strap, said punch out portions folded about a portion of an opening formed in the crown of the cylinders whereby said carton and said cylinders are simultaneously carried through said handle portions.

* * * * *